United States Patent [19]

Phillips

[11] 4,337,819

[45] Jul. 6, 1982

[54] HIGH TEMPERATURE METAL HEAT RECUPERATION WHEEL

[76] Inventor: William A. Phillips, 617 Westshire Ct., NW., Comstock Park, Mich. 49321

[21] Appl. No.: 180,685

[22] Filed: Aug. 25, 1980

[51] Int. Cl.[3] ..... F28D 19/00

[52] U.S. Cl. ..... 165/9; 165/8

[58] Field of Search ..... 165/8, 10, 9

[56] References Cited

U.S. PATENT DOCUMENTS 2,579,212 12/1951 Stevens et al. ..... 165/10

2,978,227 4/1961 Hess ..... 165/10 X 4,191,241 3/1980 Brennan ..... 165/10

*Primary Examiner*—Albert W. Davis

*Attorney, Agent, or Firm*—Varnum, Riddering, Wierengo & Christenson

[57] ABSTRACT

A metal heat recuperation wheel (12) wherein a number of structural metal spokes (38) extend radially from the core (22) through or along the metal heat exchange medium (36) into a heavy metal rim (30) to provide thermal stability necessary for gap seals (18, 20) on the rim and face of the wheel.

17 Claims, 4 Drawing Figures

HIGH TEMPERATURE METAL HEAT RECUPERATION WHEEL

DESCRIPTION

1. Technical Field

This invention relates to heat recovery apparatus. In one of its aspects, the invention relates to a metal heat recuperation wheel wherein the metal wheel is provided with sufficient structural stability so that it is relatively efficient and so that frictionless gap seals can be used.

2. Background Art

Rotary heat recuperation wheels are well known and have been used for years to recover heat in hot gaseous streams. In such devices, the wheel is made from corrugated or flat metal strips and rotates about a central axis. Spokes on each side of the corrugations hold the corrugations onto a hub. Hot gases are passed through the corrugated metal on one side of the wheel and cooler gases are passed through the corrugations at the other side of the wheel. Seals are provided peripherally around the wheels and between the opposite sides of the wheels.

The metal wheels, especially those with thin metal rims and spokes, are subject to significant uneven expansion and contraction and tend to buckle as the temperature changes during rotation of the wheel. As a result the spokes and rims warp causing dimensional changes that make sealing of the wheel very difficult and result in metal fatigue. The thermal warping and distortion of the spokes, likewise, contributes to decreased longevity of the wheel.

Rotary recuperators have also been made from highly stable ceramic. For example, see U.S. Pat. No. 3,943,953 issued Mar. 9, 1976, to Gentry. Because of the thermal stability of the ceramic, pneumatically efficient gap seals can be used around the periphery of the wheel and along the faces of the wheel. The gap seals are highly desirable because they are relatively pneumatically efficient at moderate pressures and have a relatively long life span. Further, since these gap seals do not rub against the wheel, they do not provide a drag on the wheel and require no additional energy to rotate the wheels as rubbing seals do.

On the other hand, rubbing seals are continually worn down and continually wear away the rotating wheel. Further, additional energy is required to turn the wheel against the frictional resistance of the seals.

The metal wheels are somewhat less expensive than ceramic wheels and can be used in some environments wherein corrosive gases erode the ceramic materials. For example, in the aluminum smelting industry, sodium oxide in the gases from the smelting operation, tends to corrode the ceramic wheels. High temperature metal wheels offer some advantages in this environment. However, metal wheel seals are a problem because of the significant thermal expansion of the metal. Thus, prior use of metal recuperation wheels has been limited.

DISCLOSURE OF INVENTION

According to the invention, a metal heat recuperator is made thermally stable by providing a plurality of structural steel spokes, preferably round in cross-section, which extend radially from the core through the heat exchange medium to the rim. The metal wheel is of the type which is rotated about a central axis. The wheel has a metal core and a heavy metal rim to limit actual expansion and contraction as the result of exposure to both hotter and cooler gases during rotation of the wheel. A corrugated metal heat exchange medium through which the gases may be passed is provided in an annular space between the core and the rim.

The steel spokes are desirably rigidly secured at one end in one of the core and the rim whereas the other ends thereof are radially slidable in the other of the core and the rim to allow radial expansion of the spokes with respect to the rim. To this end, the spokes can be threaded into either the core or the rim at the one end thereof.

The steel spokes are selected in size and number to materially strengthen the wheel and minimize expansion and contraction as the result of exposure to thermal temperature gradients during rotation. Therefore, the spokes are desirably made of a high strength, high temperature stainless steel, and are round in cross-section to minimize heat transfer and thermal gradients thereof.

The diameter of the spokes will vary according to the size of the heat wheel and the extent of the temperature gradients. Typically, the spoke's diameter will exceed $\frac{1}{2}''$ and preferably be about $\frac{3}{4}''$. Although large diameter spokes can be used, for practical considerations, spoke diameters in excess of $1\frac{1}{4}''$ are not preferred.

The number of spokes used in the wheel also depends on the diameter of the spokes and the size of the wheel. At least four spokes may be disposed equally about the wheel. Preferably, six to ten spokes having a diameter of about $\frac{3}{4}''$ will be used in a wheel size of about sixty inches.

The positioning of the spokes through the heat exchange medium may vary. In one embodiment, the spokes extend through only the axial central portion of the heat exchange medium. In another embodiment, the spokes extend solely along a lateral face of the heat exchange medium, interfacial to the cooler gas side of the heat exchange wheel. Additionally, this spoke is partially wrapped with a heat shield of stainless steel foil to further minimize thermal warpage. In the latter embodiment, a thin rod is inserted centrally through the heat exchange medium to rigidly secure the heat exchange medium to the wheel.

The wheels are preferably axially tapered and have annular peripheral seals made of a softer ceramic material, for example bubble alumina. The ceramic, being softer than the metal, can be worn into the desired location by adjusting the axial position of the wheel with respect to the seal. Further, ceramic facial seals can also be provided and worn into close sealing relationship in the same fashion.

BRIEF DESCRIPTION OF DRAWINGS

The invention will now be described with reference to the accompanying drawings in which.

BEST MODES FOR CARRYING OUT THE INVENTION

Figure 1:
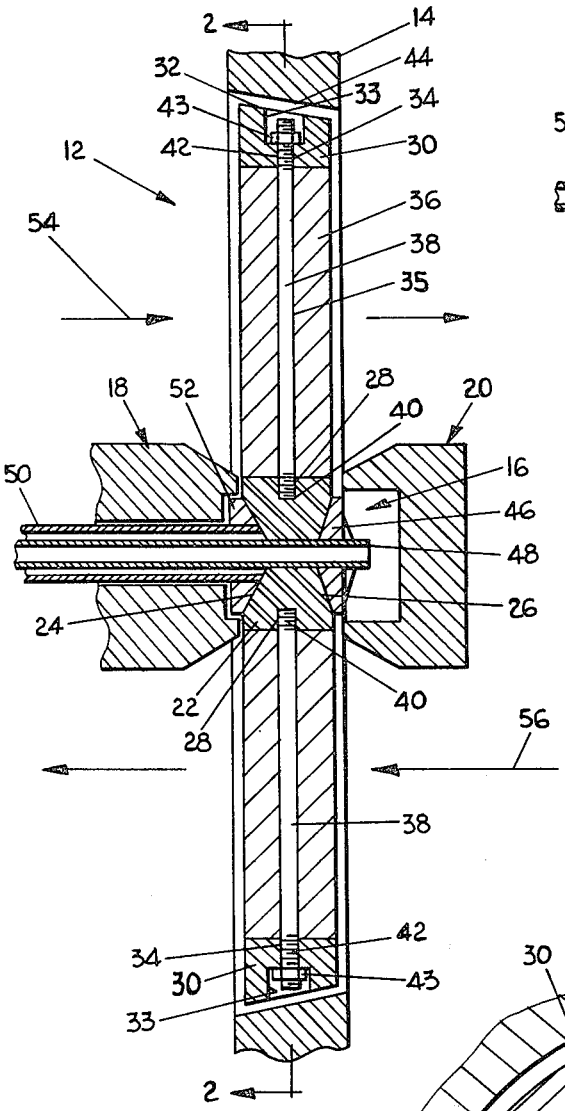
FIG. 1 is a side elevational view in section of a heat exchange wheel according to one embodiment of the invention.

Referring now to the drawings, there is shown a heat recuperator wheel 12 having an annular seal member 14, a central mounting assembly 16 and facial seals 18 and 20. Gap seals are provided between the facial seals 18 and 20 and the wheel 12. The heat recuperator wheel 12 can be used for recovering heat from a hot gas stream such as the exhaust from an incinerator. Examples of the use of such heat recuperators are disclosed in U.S. Pat. No. 3,942,953 issued to Charles B. Gentry on Mar. 9, 1976, which is incorporated herein by reference.

The heat recuperator wheel 12 has an annular core 22 with tapered inner surfaces 24 and 26. A number of threaded radial bores 28 are provided in the core 22 and extend inwardly from an outer circumferential surface thereof. Desirably, the core 22 is made of a high temperature and high strength steel. The heat recuperator wheel 12 further includes a heavy metal outer rim 30 having an axially tapered outer surface 32 which forms a gap seal with a complementary, axially tapered surface 44 of the rim 14. Radial bores 34 with pockets 33 are provided through the rim 30 in registry with the threaded radial bores 28 of the core 22.

A heat exchange medium 36, for example, a corrugated stainless steel metal wrapping, is wrapped spirally around the core in the annular space between the heavy metal rim 30 and the core 22. Corrugated metal wrapping is well known in the art of metal heat recuperators. Radial bores 35 are provided in the heat exchange medium 36 in registry with the radial bores 28 and 34.

According to the invention, structural radial spokes 38 extend through the bores 35 in the heat exchange medium 36 between the heavy metal outer rim 30 and the core 22 to enhance the thermal stability of the wheel. The spokes 38 are preferably high temperature, high strength steel rods, and round in cross-section to minimize heat transfer thereof. The diameter of the spokes is desirably $\frac{3}{4}''$, although the diameter of such spokes can vary from $\frac{1}{2}''$ to $1\frac{1}{4}''$ in diameter, depending on the size of the wheel and the environment in which the wheel is to be used. At least three spokes are distributed equally about the wheel. The number of spokes used, though, is dependent on the diameter of the spokes and wheel. Preferably, six to ten spoke $\frac{3}{4}''$ in diameter will be used in a wheel having a diameter of sixty inches. The spokes 38 have a threaded end 40 which threadably engages the holes 28 in the core and are retained thereby. The outer ends 42 of the spokes 38 are threaded and slidably received in the radial bores 34 of the heavy metal outer rim 39 and are retained therein by nuts 43 which are threaded onto the ends 42 to permit axial thermal expansion of the spokes with respect to the rim 30.

The central mounting assembly 16 desirably is of the type provided in the U.S. Pat. No. 3,978,913 issued to Phillips on Sept. 7, 1976, which is incorporated herein by reference. Briefly, the mounting system comprises an annular wedge member 46 secured to an inner pipe 48 which extends through the core 22 of the wheel 12. The wedging surfaces of the annular wedge member 46 congruently abut the tapered inner surface 26 of the core 22. An outer pipe 50, coaxial with the inner pipe 48 mounts an annular wedge member 52 which abuts the tapered inner surface 24 of core 22. The annular wedge member 52 has a wedging surface which is congruent with or complementary to the tapered inner surface 24 of core 22. The inner pipe 48 is biased through means (not shown), for example Belleville springs, with respect to the outer pipe 50 such that the wedge members 46 and 52 are biased toward each other in contact with the core 22. An example of a technique for biasing the inner pipe 48 with respect to the outer pipe 50 is disclosed and claimed in the aforementioned Phillips U.S. Pat. No. 3,978,913.

In operation, a cold gas supply is passed through one side of the wheel 12 in the direction, for example, of the arrows 54 and a hot gas supply stream passes through the other side of the wheel 12, for example, in the direction of arrows 56. The wheel 12 is rotated whereby the heat imparted by the hot gas supply stream to the heat exchange medium 36 is transferred to the cold gas on the other side of the wheel. As the wheel rotates, it is subjected to drastic thermal changes which tend to warp the wheel. However, the spokes 38 rigidly reinforce the wheel and resist the thermal strain on the wheel. The spokes, although subjected to certain thermal stresses, will expand in the radial direction rather than warping in the axial direction in which the rim has a tendency to warp. The floating mounting of the spoke ends 42 in the heavy metal outer rim 30 provides the necessary expansion for the spokes 38 without deforming or otherwise stressing the heavy metal outer rim 30. Thermal warping is, likewise, reduced by the heavy metal outer rim 30. The rim 30 has a mass sufficient so that it is thermally stable as the wheel rotates and so that it is dimentionally unaffected by surface temperature changes.

Thus the invention provides a relatively stable metal wheel 12 for recuperation of heat in a hot gas stream. Prior art wheels tend to expand and contract when subject to drastic thermal gradients between the faces. The invention eliminates the spokes on the hot side of the wheel where the thermal gradients between the two gas streams is most significant. The spokes, particularly the ones interfacial with the hotter gases, tend to warp in the direction of the higher temperature.

The improved stability of the invention means that close tolerances can be maintained between the wheel 12 and the seals 14, 18 and 20. Thus, the heat recuperator wheel 12 can use gap seals which exhibit less frictional resistance, thereby requiring far less power to drive the wheels. Further, the seals 14, 18, and 20 and the wheel 12 last significantly longer because they are not worn by rubbing contact with the wheels 12.

Figure 3:
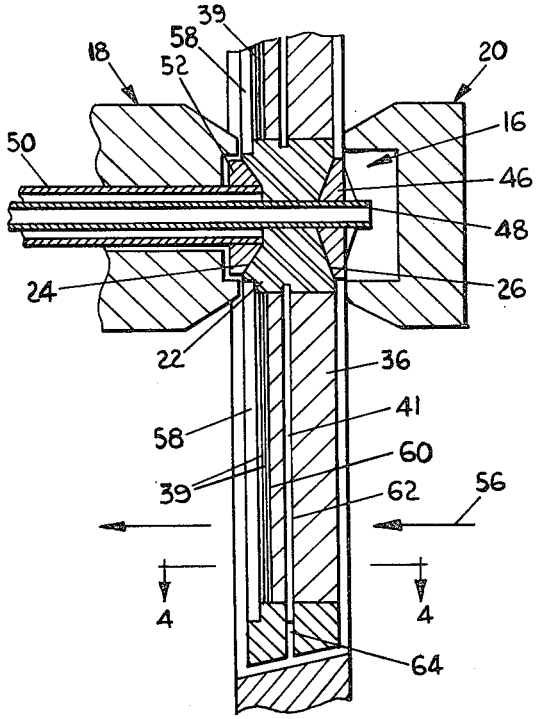
FIG. 3 is a side elevational view in section of a heat exchange wheel according to another embodiment of the invention.
Figure 4:
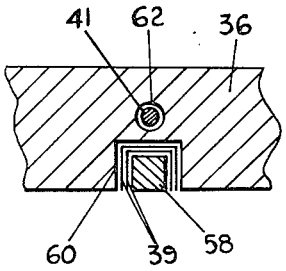
FIG. 4 is a cross-sectional view taken along lines 4—4 of FIG. 3.
Figure 2:
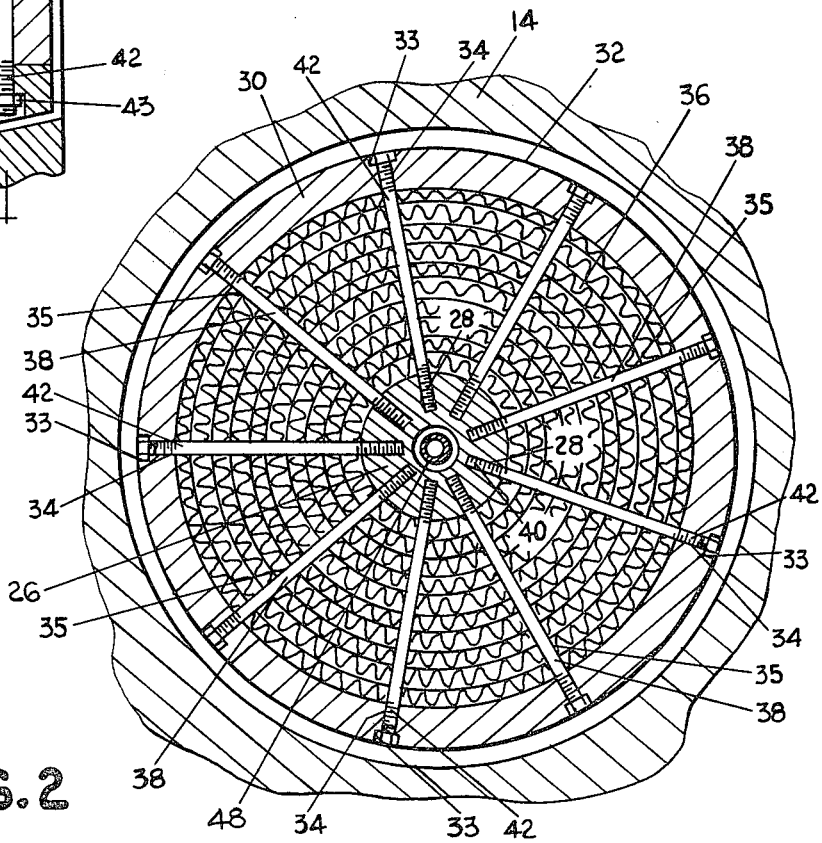
FIG. 2 is a front elevational view taken along lines 2—2 of FIG. 1.

Referring to FIGS. 3 and 4, there is shown a second embodiment of the invention where like numerals are used to designate like parts. In this embodiment, structured spokes 58 extend along a face of the heat exchange medium 36, interfacial to the cooler gas side 54 of the heat recuperator wheel 12 and in milled slots 60. This placement of the spokes 58 further reduces expansion and contraction of the spokes 58 resulting from exposure to both hotter and cooler gases during rotation of the wheel 12. The spokes 58, are rectangular in shape and are selected to fit within the milled slots 60. A heat shield 39, made of several layers of stainless steel foil, is provided around three sides of the spokes 58 to further protect the spokes 58 from thermal warping. No spokes are provides on the hotter gas side 56 of the heat recuperator wheel 12. Therefore, in this embodiment, a non-structural thin rod 41, preferably $\frac{1}{8}$ to $\frac{1}{4}$ inch in diameter, is inserted centrally through bore 62 in the medium 36 to rigidly secure the heat exchange medium 36 to the core 22.

The rod 41 is slidably positioned in a bore 64 in rim 30 so that it may expand and contract without buckling. The rod 41 is fixed at its rim end by threading or otherwise in the core 22. The spokes 58 are secured to the rim 30 and the core 22 by welding and carry the entire support for the rim 30. Typically, in a 60″ wheel, such spokes 58 are made from $\frac{3}{4}'' \times 1\frac{1}{2}''$ bar stock.

Reasonable variation and modification are possible within the scope of the foregoing disclosure, the drawings and the appended claims without departing from the spirit of the invention.

The embodiments of the invention in which an exclusive property or priviledge is claimed are defined as follows:

1. An improved gaseous heat recuperator having a metal wheel with a rim, a core and a heat transfer medium therebetween; means for supplying a heated gaseous stream to one side of the wheel and means for supplying a cooler gas to another side of the heat exchange wheel; means for rotating the wheel about a central axis thereof to transfer the heat from the heated gaseous stream to the cooler gaseous stream, wherein the improvement comprises:

a plurality of structural steel spokes which extend radially between said core and said rim of said metal wheel, each of said spokes having one end retained in one of the core and the rim;

the other end of each spoke being radially slidable in the other of the core and the rim to allow for thermal expansion of the spokes; and means for maintaining the position of the rim with respect to the core;

the spokes being of a size and number, and at a position within the wheel to materially strengthen the wheel and minimize actual expansion and contraction of the spokes as a result of exposure to both hotter and cooler gases during rotation of the wheels.

2. A gaseous heat recuperator according to claim 1 wherein the metal wheel rim of is of a thickness to minimize actual expansion and contraction of the rim as the result of exposure to both hotter and cooler gases during rotation of the wheel.

3. A gaseous heat recuperator according to claim 2 wherein one end of the spoke is rigidly secured in one of the core and the rim.

4. A gaseous heat recuperator according to claim 3 wherein the one end of the spoke is threaded into the core or rim.

5. A gaseous heat recuperator according to claim 1 wherein each of the spokes extends through an axial central portion of the metal heat transfer medium.

6. A gaseous heat recuperator according to claim 5 wherein each of the spokes has a diameter of at least $\frac{1}{2}''$.

7. A gaseous heat recuperator according to claim 6 wherein each of the spokes has a diameter of about $\frac{3}{4}''$.

8. A gaseous heat recuperator according to claim 7 wherein an annular seal of ceramic material surrounds the outer periphery of the wheel and forms a gap seal therewith.

9. A gaseous heat recuperator according to claim 2 wherein each of the spokes extends solely along a face of the metal heat transfer medium, interfacial to the cooler gas side of the heat exchange wheel and means for retaining the metal heat transfer medium between the core and the rim.

10. A gaseous heat recuperator according to claim 9 wherein each spoke is protected from further heat exposure with a heat shield.

11. A gaseous heat recuperator according to claim 10 wherein said heat shield consists of at least one thin layer of stainless steel foil.

12. A gaseous heat recuperator according to claim 11 wherein said heat shield consists of several thin layers of stainless steel foil.

13. A gaseous heat recuperator according to claim 12 wherein each of the spokes has a diameter of at least $\frac{1}{2}''$.

14. A gaseous heat recuperator according to claim 13 wherein each of the spokes has a diameter of about $\frac{3}{4}''$.

15. A gaseous heat recuperator according to claim 9 wherein an annular seal of ceramic material surrounds the outer periphery of the wheel and forms a gap seal therewith.

16. A gaseous heat recuperator according to claim 15 wherein ceramic facial seals are provided at the face of the wheel to separate the gaseous streams, the facial ceramic seals forming a gap seal with the face of the ceramic wheel.

17. A gaseous heat recuperator according to claim 16 wherein a circumferential surface of the rim of the wheel is axially tapered and the annular seal is axially tapered complementary to the rim circumferential surface to form the gap seal.

* * * * *